US005144782A

United States Patent [19]

Paquette et al.

[11] Patent Number: 5,144,782

[45] Date of Patent: Sep. 8, 1992

[54] DOUBLE-LEVEL DRAINAGE SYSTEM FOR FLAT ROOFS

[76] Inventors: Jean-Paul Paquette, 91 Rang des Etangs, St-Jean-Baptiste de Rouveille, Canada, J0L 2B0; Luc Trudeau, 1161 Dunraven Street, Mt. Royal, Canada, H3P 2M2

[21] Appl. No.: 567,791

[22] Filed: Aug. 15, 1990

[51] Int. Cl.[5] ..... E04B 5/00

[52] U.S. Cl. ..... 52/408; 52/14

[58] Field of Search ..... 52/13-16, 52/408, 409, 302, 303, 169.5, 410

[56] References Cited

U.S. PATENT DOCUMENTS

| | | | |
|---|---|---|---|
| 4,397,126 | 8/1983 | Nelson | 52/408 X |
| 4,530,193 | 7/1985 | Ochs | 52/408 |
| 4,651,494 | 3/1987 | Van Wagoner | 54/409 X |
| 4,937,990 | 7/1990 | Paquette | 52/408 X |

*Primary Examiner*—Richard E. Chilcot, Jr.
*Attorney, Agent, or Firm*—Pierre Lespérance; François Martineau

[57] ABSTRACT

A draining system for water which may collect between the upper and lower membranes of flat, horizontal or slightly sloped insulated roofs upon perforation of the upper membrane. The insulating panels located between the two membranes are provided at both their upper and lower faces with a network of intersecting grooves, and these networks communicate with each other through passages made through the insulating panels or constituted at the panel joints. A lower drain member is sealed to and opens above the lower membrane to drain any water having seeped under the broken or perforated upper membrane, so as to prevent deterioration of the insulating panels and water accumulation which may provoke considerable roof overload problems. In certain roof constructions, the network of upper grooves is not necessary.

19 Claims, 12 Drawing Sheets

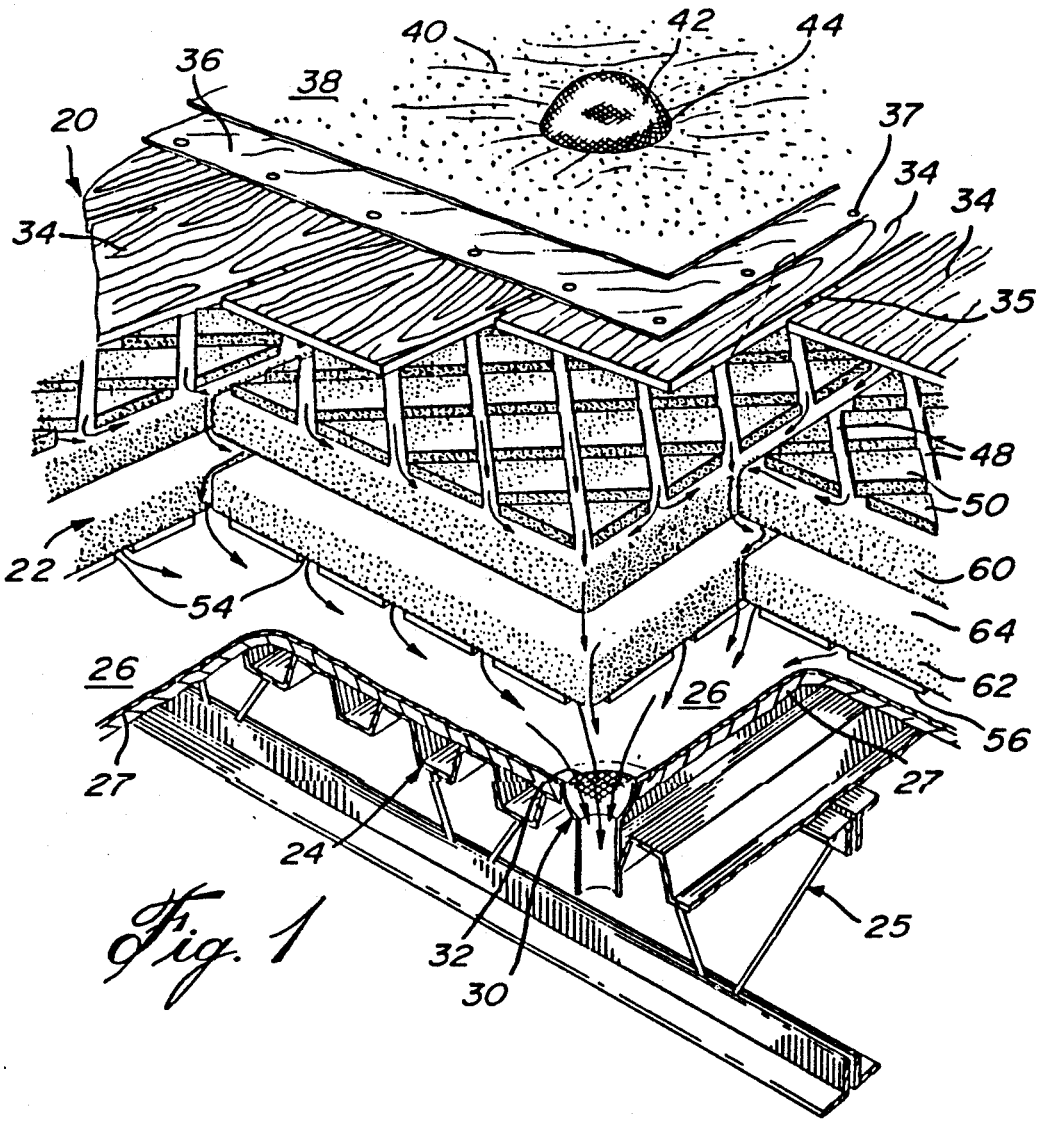
Fig. 1
Fig. 2
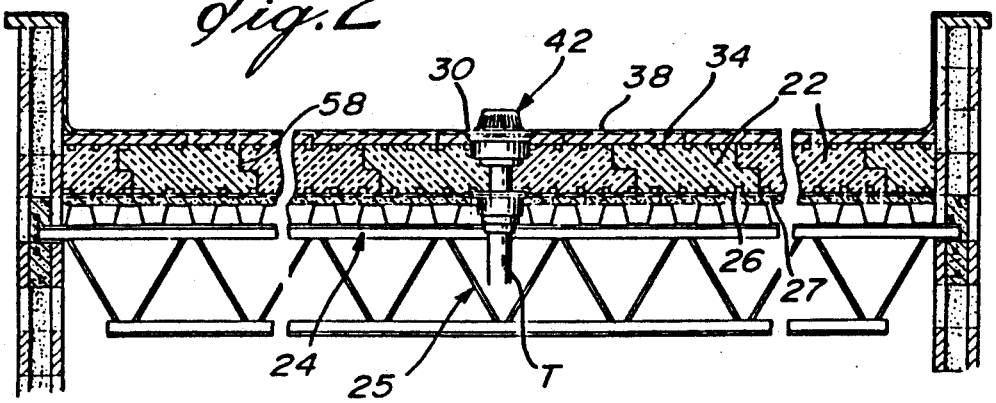

Fig. 18
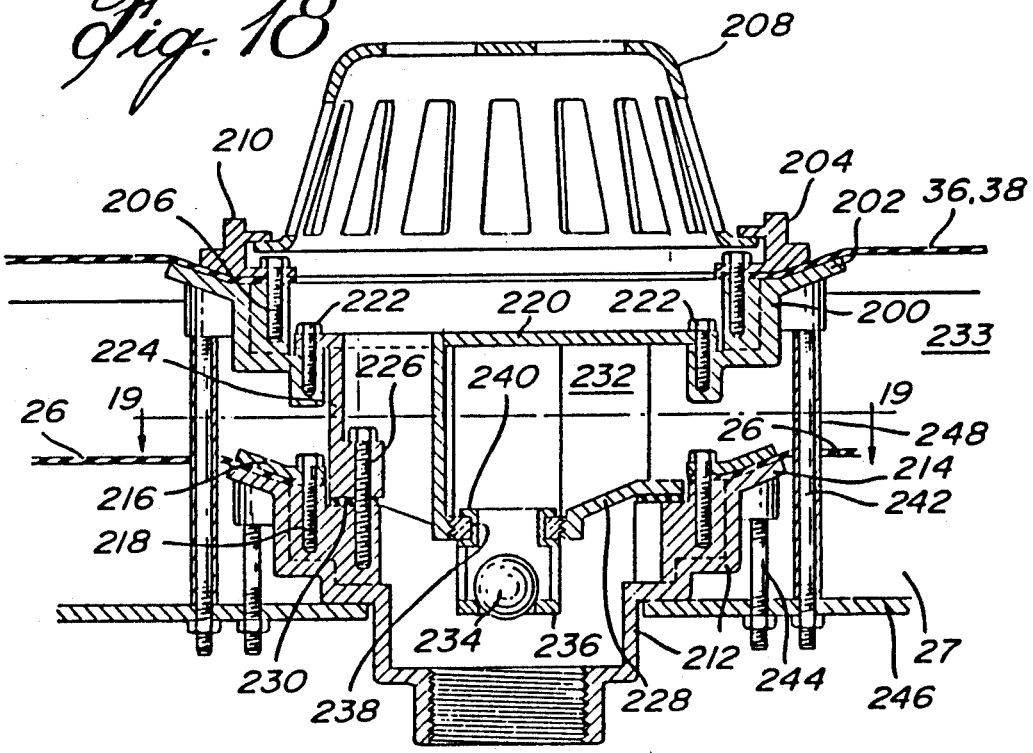
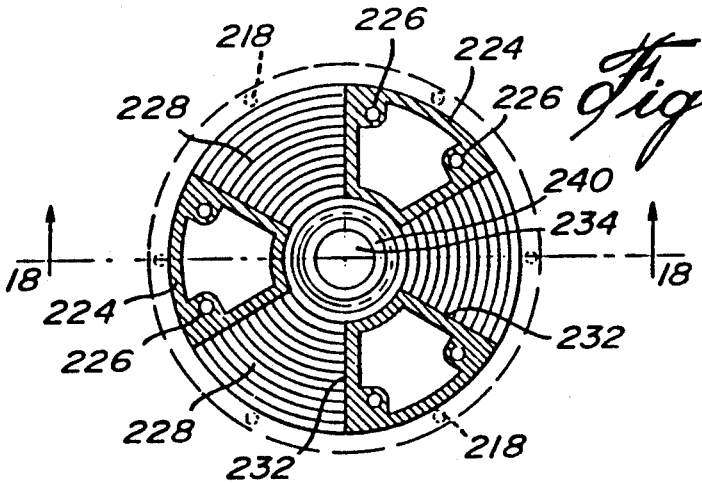
Fig. 19

DOUBLE-LEVEL DRAINAGE SYSTEM FOR FLAT ROOFS

FIELD OF THE INVENTION

The invention relates to the draining of water having seeped under the water-tight membrane of flat roofs having insulating panels.

BACKGROUND OF THE INVENTION

More than thirty years ago, horizontal roofs were common in commercial buildings having a raised peripheral ridge, but being slightly sloped toward a drainpipe projecting transversely from the roof. This drain was designed to collect rainwater or melting snow which would build up on the roof. However, for a variety of reasons, this roof was not totally satisfactory. Henceforth, the considerable use of concrete and metallic structures for buildings, in Canada and the United States, has enabled use of completely flat roofs, i.e. having a zero slope i.e. completely horizontal.

In these reinforced structures, the building upper frame often consists of a steel planking which is not well suited to the installation of a uniformly fluid-tight membrane. In view of resolving this problem, experts have devised the addition of a layer of gypsum, mechanically secured to the steel planking so as to thus offer a uniformly uninterrupted surface to support a lower fluid-tight membrane which receives a warm asphalt layer so as to thus become a fluid-tight membrane, preventing any water or water vapour seeping from the interior to the exterior and vice-versa. On this lower membrane, insulating panels are installed when the asphalt is still warm. A wood fibre support plank is then applied against the insulating panels, so as to provide a uniform, flat support for the upper watertight membrane. A surface drainpipe permits the discharge of surface water from the roofing.

With time and wear, it will be understood that the upper membrane will eventually rupture itself much sooner than the lower membrane. Water will seep in between the two membranes. Since the lower membrane remains watertight, water will accumulate between the two membranes soaking the insulating panels and decreasing their heat-insulating efficiency.

Water build-up between the two membranes is concealed from view. Therefore, it is not possible to verify de visu if there is good roof draining. The building structure is then susceptible to experience unexpected loads exceeding tolerance levels.

Then, one should not exclude the possibility of roof collapse, with all the material and human risks involved. This is the more so when considering computations made by the two present joint-inventors, which have revealed that such overload values will exceed the safety margins generally allowed for the construction of flat roof buildings.

OBJECTS OF THE INVENTION

The gist of the invention is to provide, in addition to the draining of surface water, an efficient system for drainage of water having seeped between the upper and lower water-tight membranes of flat roofs, when the liquid-tight properties of the upper membrane have been compromised.

A corollary object of the invention is to reduce the risks of collapse of flat roofs, and thus to reduce the associated risks to material and men.

A further corollary object of the invention is to preserve the integrity of insulating panels being submitted to seeping water, in view of their physical-load support capability as well as of their thermal insulating properties, by preventing their deterioration by water and also to keep same in place during eventual replacement of the upper membrane, which would thus constitute a major saving for the building owner.

SUMMARY OF THE INVENTION

The invention thus relates to an improvement for a building roof draining system for a horizontal or slightly sloped flat roof, including a heat insulating layer formed of plurality of insulating panels joined side by side an upper water-tight membrane, and a lower fluid-tight membrane respectively on and under the panels, and an upper drain member sealed to and opening above the upper membrane for draining surface from the roof, said improvement comprising first and second water passage means between the upper membrane and the layer and between the layer and the lower membrane respectively and a third water passage means through the thickness of the heat-insulating layer, all the passage means intercommunicating; a lower drain member, sealed to and opening above the lower membrane and under said layer for draining from the roof water which may have collected between the two membranes. The two drain members may be combined and a buoyant check valve provided to prevent surface water from entering the space between the two membranes.

Profitably, said first water passage means consists in a network of intersecting sloped grooves having single or multiple directions, formed in the upper face of the panels, said upper face being used as a support for the upper water-tight membrane.

It is envisioned that the second water passage means consists in a network of intersecting grooves made in the lower face of said panels, said lower face, designed to lay onto the lower membrane used as a namely a vapor barrier sheet.

The first passage means may consist in a spacing between the upper water tight membrane and the upper face of said panels.

The third water passage means may consist of bores made through the insulating panels but preferably of channels formed at the junctions of the panels.

Profitably, the thickness of the insulating panels decreases toward said upper drain.

Advantageously, the insulating panels are maintained in the same plane by lap joints.

Preferably, each panel is quadrangular and constitutes a first and a second downwardly directed notches on two adjacent sides of the panel and a third and a fourth upwardly directed notches on the other two sides of the panel to create a double lap joint with an adjacent panel, each notch comprising a vertical face and a horizontal face, and the third water passage means including a plurality of grooves in the horizontal face of the first notch and a vertical groove in the vertical face of the second notch, this vertical groove being laterally offset relative to the nearest groove of said plurality of grooves, the junction of the first and third notches constituting a recess which establishes a fluid-communication between the grooves of said plurality and said vertical groove when the double lap joint is completed.

Preferably, a layer of thermal protection covers and adheres to the lower face of the insulating panels, said layer protecting the panels against large temporary variations of temperature e.g. when warm (liquified) asphalt is spread onto the lower membrane to adhere the panels thereto.

Profitably, there is further comprising a system to indicate the presence of water within the intermembrane spacing. In such a case, it is envisioned that said system comprises electrodes exposed in the lower drain member.

Alternately, said system comprises a transparent bowl communicating with said lower drain member and a buoyant ball in said transparent bowl, the latter installed at a level lower than that of the said lower drain member, and water discharge means for discharging water which may have built up within the intermembrane spacing, the latter means comprising an outlet with a valve in communication with said bowl. In this latter case, the bottom of said transparent bowl is provided with a normally closed hole, to drain said bowl.

BRIEF DESCRIPTION OF THE DRAWINGS

FIG. 1 is a broken, perspective view of a flat roof comprising a two-level draining system according to the invention;

FIG. 2 is a sectional view of the flat roof of FIG. 1, but making use of the two-level drain of FIG. 13;

FIGS. 18–19 are vertical planar sections along lines 18—18 of FIG. 19 and 19—19 of FIG. 18, respectively, showing a third embodiment of two-level drain;

Figure 28:
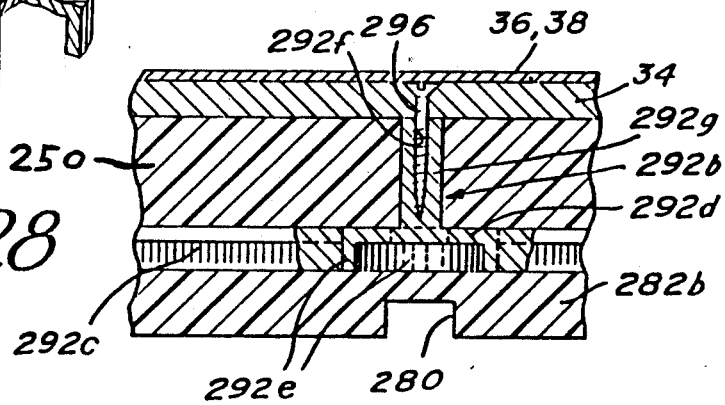
FIG. 28 is a partial section of an insulating panel modified by the incorporation of a securing grate.

FIG. **29*a* is a partial perspective view of the grate of FIG. 28**; and

Figure 30:
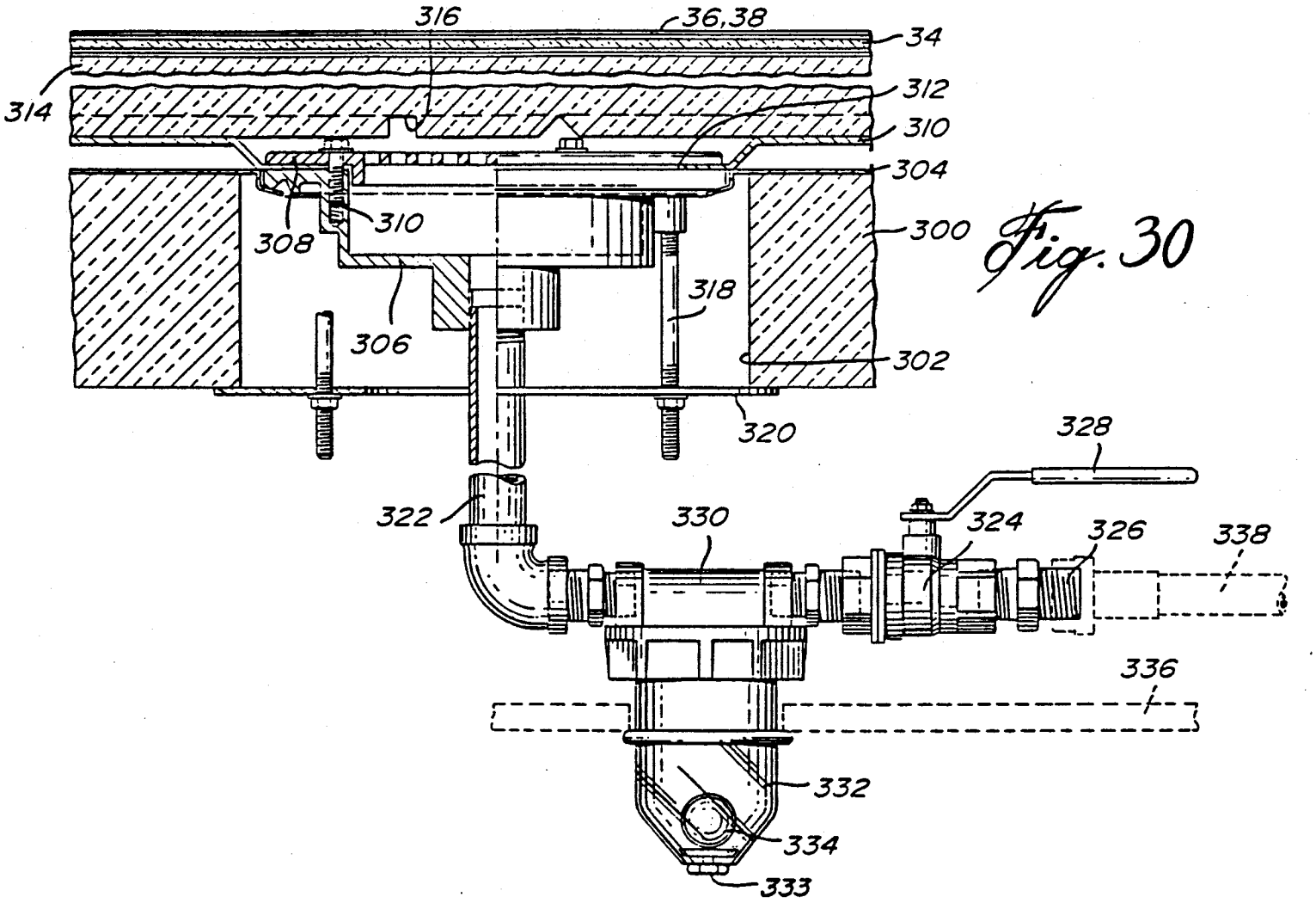

FIG. 30 is a partial section of a roofing system according to the invention at the level of the lower drain, the latter being modified to provide a visual clue as to water buildup in the spacing between the two membranes.

DETAILED DESCRIPTION OF THE INVENTION

The flat roof according to the invention is shown at 20 in FIGS. 1–2 as comprising an insulating layer formed of an assembly of self-draining insulating panels, 22, of substantial thickness and detailed below. The panels 22 are supported by a steel planking 24 constituting the upper portion of the frame 25 of the building covered by the roofing 20. A vapor barrier or fluid-tight membrane 26 is positioned under the panels 22 so as to cover a flat structural tile 27, at the upper face of the steel planking 24. The membrane 26, which constitutes a lower fluid-tight membrane, is provided with at least one drain 30 which is sealed to and opens above lower membrane 26. The drain 30 may be funnel-shape, installed endwisely of a vertical water discharge pipe (not illustrated) and provided with a filtering grate 32.

Support planks 34 are installed to the upper face of panels 22, in a common plane but slightly spaced from one another by spacers 35 about their rims, and used to support for example two rows of water tight sheets 36, 38 which are themselves covered by a layer of asphalt and then of small gravel 40. The sheets 36, 38 constitute the upper water-tight membrane. The lower sheet 36 may be nailed or glued at various intervals to the support planks 34. An upper drainpipe 42 is sealed to and opens above the upper membrane 36, 38 to drain surface water. In FIG. 1, this drainpipe, shielded by a filtering grate 44, is shown as being independent from the lower drain 30 and provided with its own water discharge pipe. In FIG. 2, the two drains are combined, the upper drain 42 fluidingly discharging into the lower drain 30. Several preferred embodiments of such two-level drains will be hereinafter described, by having reference to FIGS. 13–15 and 18–21.

In accordance with the invention, there is further provided first water passage means for water circulation between the upper membrane 36, 38 and the upper face of the panels 22, second water passage means for water circulation between the lower face of the panels 22 and the fluid-tight membrane 26, and third water passage means through the panels or their lap joints and which enables communication between the first and second water-passage means.

We will now detail panel 22. It is made from an insulating material, e.g. rigid polystyrene or polyurethane foam or the like, with closed cells and of a thickness of at least a few centimeters accordingly with the building industry norms and regulations. The upper face 46 of panel 22 is provided with a network of sloped grooves 48 having single or multiple directions, which intersect one another and define abutment legs 50 onto which rest the planks 34. The lower face 52 of the panel 22 is also provided with a network of intersecting grooves 54 and define abutment legs 56 which rest onto the lower membrane 26. The abutment legs 50 and 56 are illustrated as having a square shape; however, their shape may be circular, oval, rectangular, triangular, diamond-shaped, or a combination of these shapes. Hence, free water flow is obtained without the water becoming trapped, whatever the slope direction of the bottom of grooves 48 or of the lower membrane 26, as the case may be.

Preferably, the grooves will be cross-sectionally quadrangular, for example square.

In the case of panels 22 having small dimensions (e.g. one square meter or less), the upper face of the panels may be flat and grooveless.

The insulating panels are maintained in a common plane by lap joints 58 which are conventionally formed by a panel edge notch defined by the upper and lower vertical faces, 60, 62, connected by the horizontal face 64. As shown in FIGS. 6 to 9, the notch in two adjacent sides of the panel is inverted relative to the notch in the two other sides of the panel. However, the panels 22 may have flat edges and be endwisely connected with spacers if required, which spacers may be integrally molded to the panels. The insulating panels may have a constant thickness, as shown in 22*a* and 22*b*, 22*b*' in FIGS. 3 and 4 respectively, or of variable thickness, as shown at 22*c* in FIG. 5 wherein the draining direction in grooves 48 is indicated by arrow 66.

Figure 16:
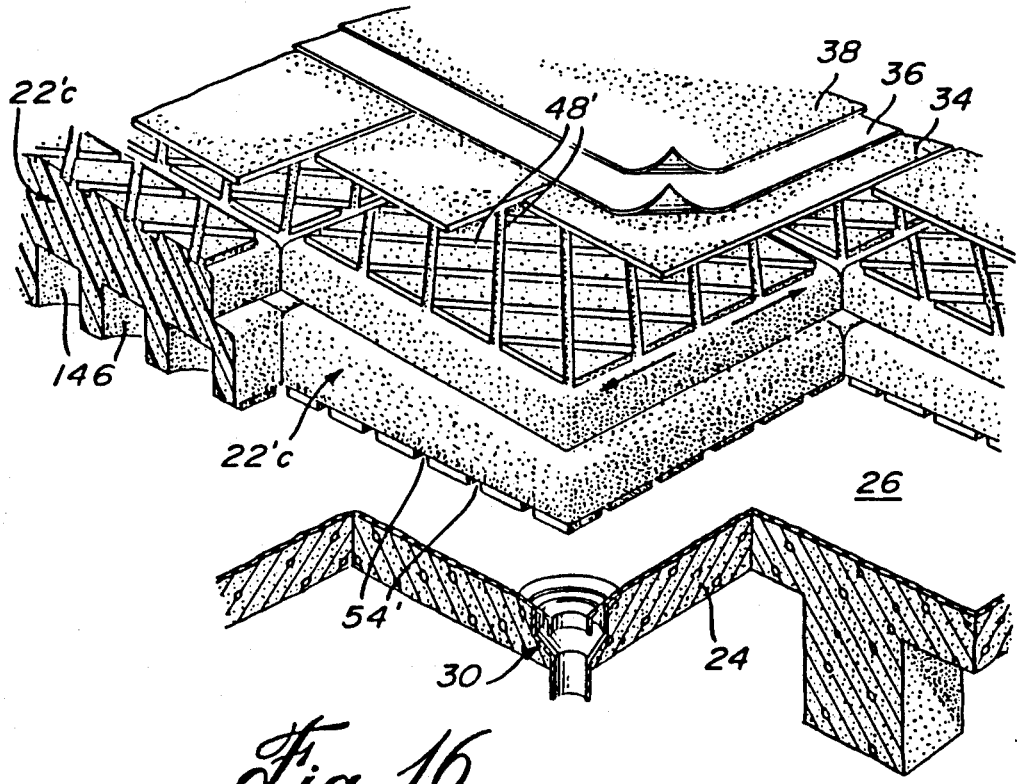
FIG. 16 is a broken perspective view similar to FIG. 1 but showing the use of modified insulating panels.
Figure 17:
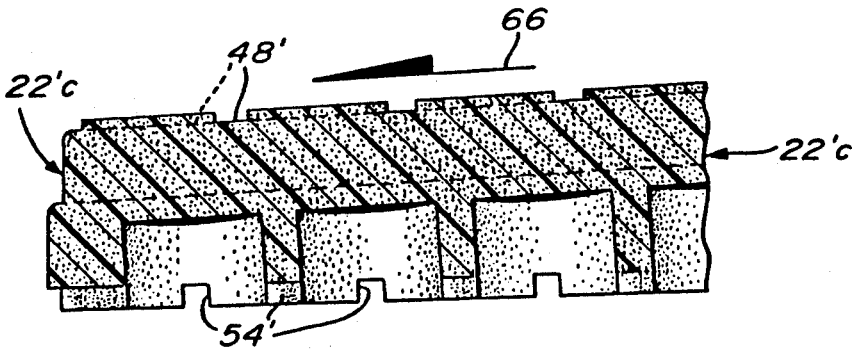
FIGS. 17 is a section of one of the modified panels from FIG. 16.

When panels 22*c* having a sloped upper face are employed, those of these panels which are sufficiently spaced from the upper drain must have a larger thickness than that required to satisfy the established norms for roofing insulation properties. Too much insulating material would then be required. To circumvent this drawback, one needs only to modify the panels 22*c* as shown in FIGS. 16 and 17; the panels 22'*c* are provided with cavities 146 at their lower face; the depth of these cavities is in direct relation to the thickness of the panel section in register therewith. The lower grooves 54' open into these cavities which thus form part of the network of grooves. The upper grooves 48' are similar to those in panel 22*c* of FIG. 5.

Figure 3:
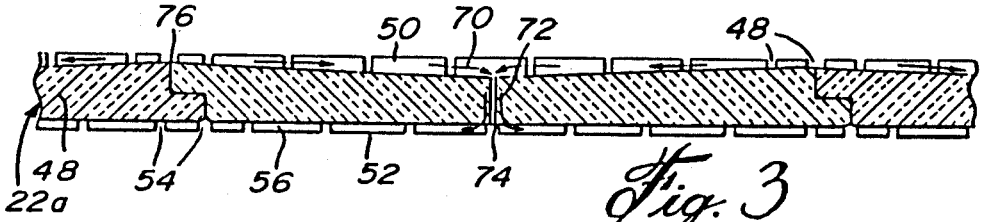
FIGS. 3 to 5 are transverse sectional views of various embodiments of self-draining insulating panels for roofs according to the invention, taken along lines 3—3 to 5—5 respectively of FIGS. 6–7, 9 and 8 respectively.
Figure 6:
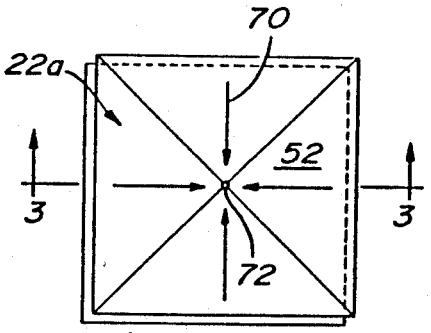
FIGS. 6 to 9 are schematic plan views of various embodiments of self-draining insulating panels for roofs, according to the invention, showing the direction of flow of rainwater having seeped into the upper condensation grooves network, this network being partially illustrated in FIGS. 7 and 8.
Figure 7:
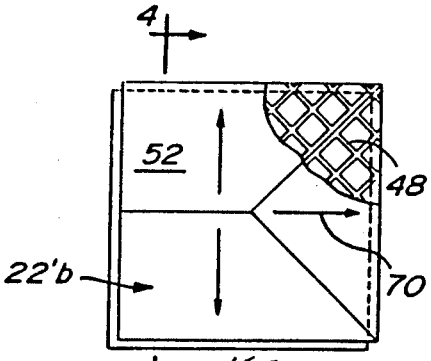

Communication between the networks of upper grooves 48 or 48' and lower grooves 54 or 54' may be produced either through the panel, or about its periphery through the lap joints with the nearby panels. The first embodiment is shown in FIGS. 3 and 6; the bottom 68 of the upper grooves 48 of panel 22*a* is inclined along the arrows 70 toward a central hole 72 which extends through the panel and opens into the bottom 74 of a lower groove 54.

The top corners 76 of the joined panel edges are sharp to prevent water retention at these joints.

Figure 4:
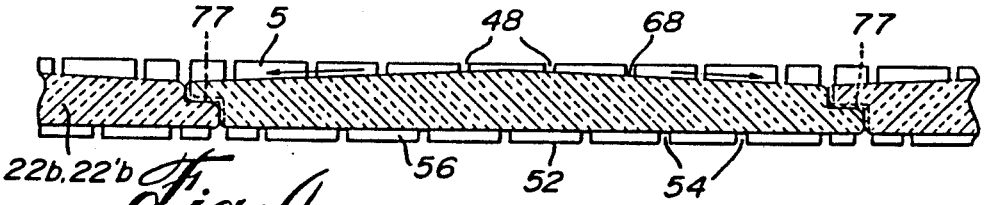
Figure 5:
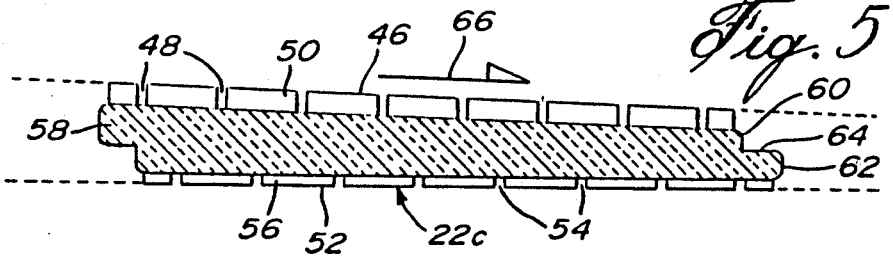

FIGS. 4–5 and 7–9 show various embodiments for the second way the communication may be effected, namely, about the periphery of the panel through channels 77 (FIG. 4). The bottom 68 of these upper grooves 48 may be inclined along two sectors (panel 22*c* at FIG. 8), three sectors (FIG. 7 and panel 22'*b*) or four sectors (panel 22*b*, FIG. 9). Thus, water in grooves 48 will flow along arrows 70.

Figure 10:
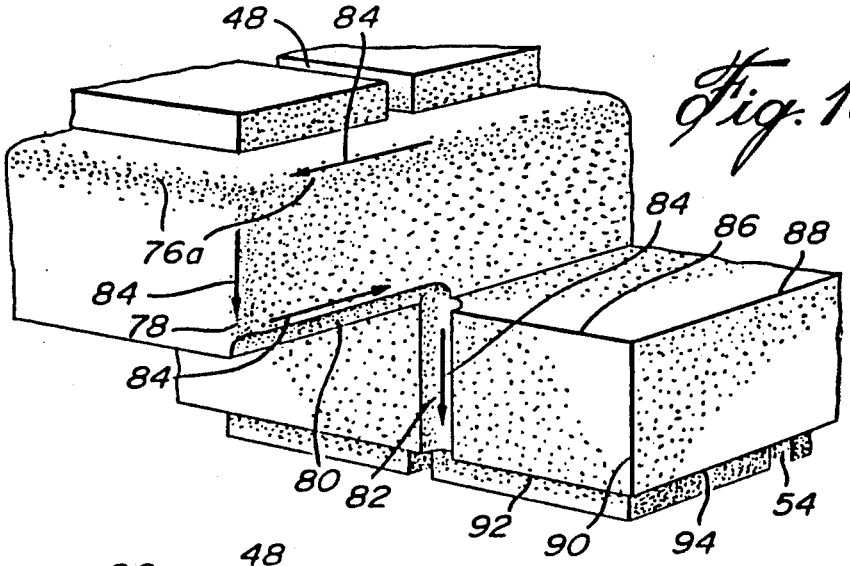
FIGS. 10 and 11 are schematic perspective views of self-draining insulating panels according to the invention, enlarged relative to those of FIGS. 2 to 5, showing two embodiments of canalization systems for rainwater through the lap joint of said panel.
Figure 11:
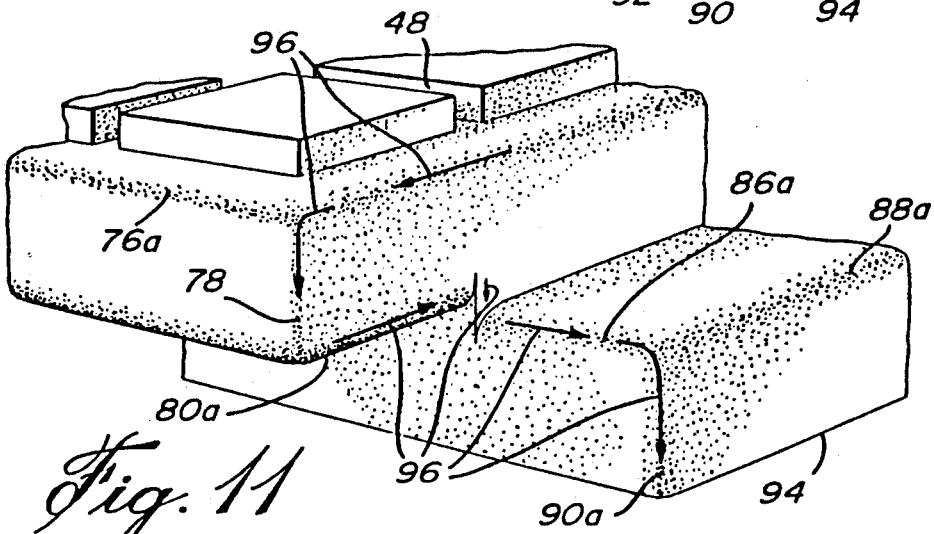

The peripheral channels 77 may have various shapes. FIGS. 10 and 11 show two preferred shapes. In FIG. 10, the upper edges 76*a* are rounded as well as the corner edge 78; the latter is positioned endwisely of a quarter circle groove 80 which constitutes the lower horizontal edge of the projecting part of the faces 60 and 64 of the lap joint 58. The groove 80 communicates with a vertical, half circular groove 82 provided into the vertical face 62 and opening into the face 64 of the joint and into the bottom 74 of a lower groove 54. The arrows 84 show the water travel in the joint defined by the corners of the two panels connected with a third panel. It is to be noted that the edges 86, 88, 90, 92 and 94 are sharp edges.

In FIG. 11, the half-circular groove 82 of FIG. 10 is eliminated; the quarter-circular groove 80 of FIG. 10 is replaced by a rounded edge 80*a* and the sharp edges 86, 88, 90 FIG. 10 are replaced by rounded edges 86*a*, 88*a*, and 90*a*. The arrows 96 show the direction of water travel; it is to be noted that it is not as direct as in FIG. 10. In both instances, thermal losses are limited due to the presence of the channels which allow mutual contact of adjacent panels.

Figure 12:
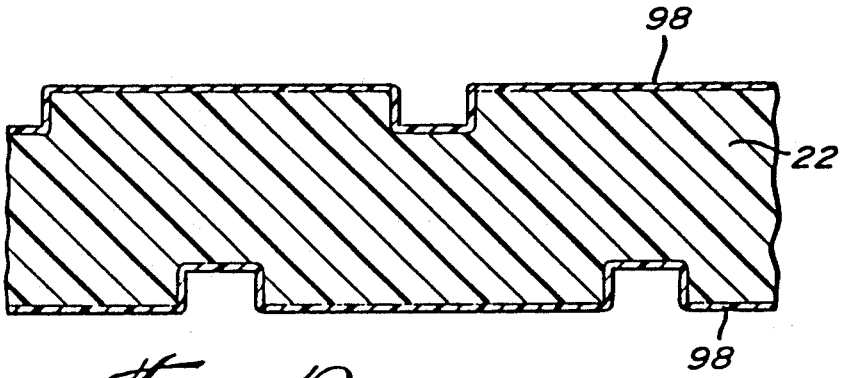
FIG. 12 is a partial section of the insulating panel.

In FIG. 12, there is shown that the lower and upper faces 52, 46, as well as the grooves 54, 48, are covered by a thermal shield layer 98 which adheres to the panel. This layer 98 does not cover the panel edges, i.e. faces 60, 62, 64. The layer may be a layer of cement or a cardboard of 0.6 centimeters or more thickness, and is used to prevent melting of the plastic foam constituting the panel when the latter comes in contact with warm (liquid) asphalt.

Figure 13:
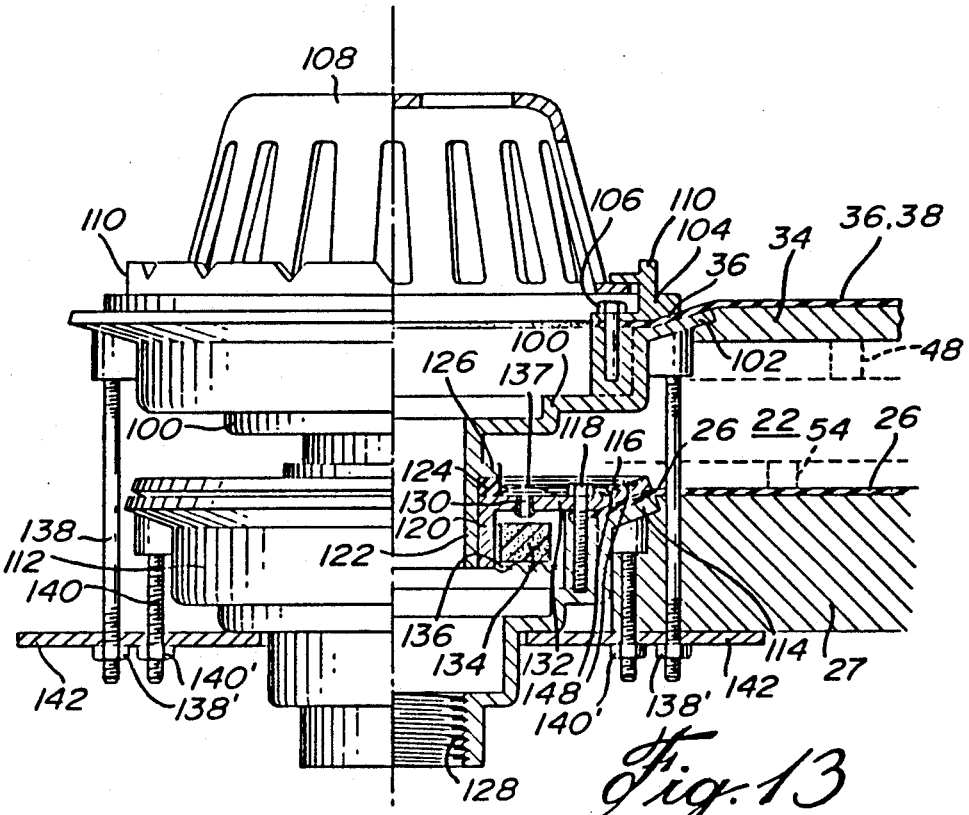
FIGS. 13 to 15 are enlarged, partly sectional, elevational views of two embodiments of two-level drains forming part of the draining system according to the invention, as installed on flat roofs, FIG. 15 showing the two drainpipe sections in separate positions.
Figure 14:
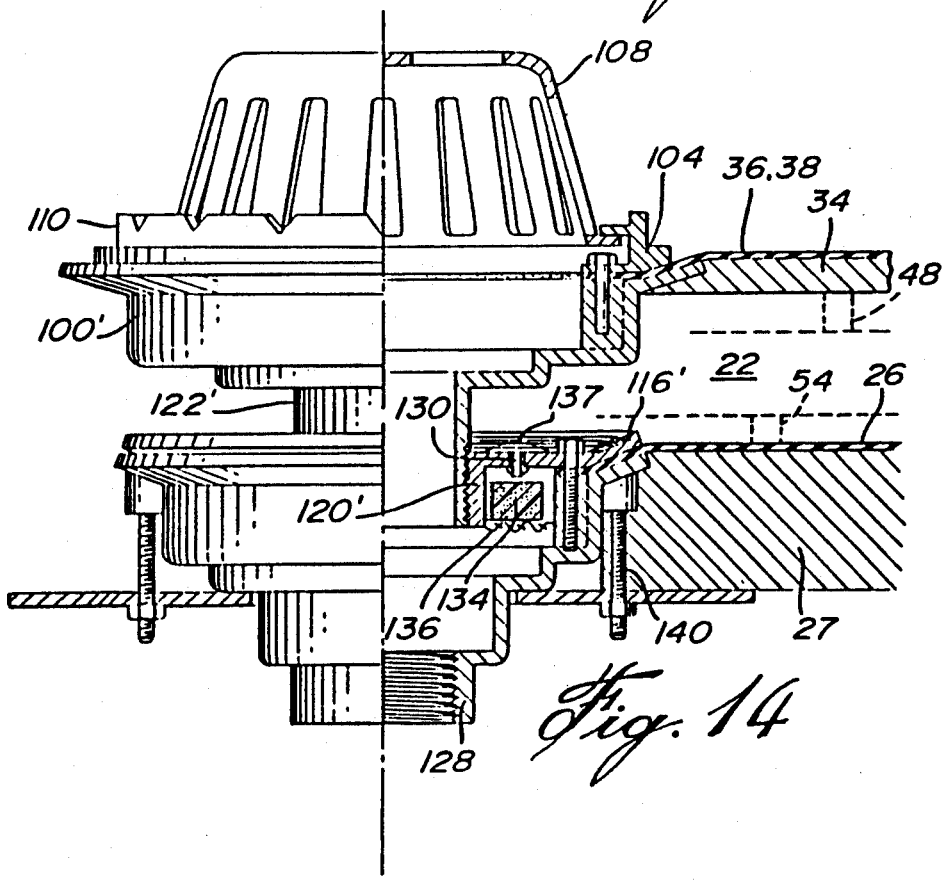

FIGS. 13 and 14 show two embodiments of two-level drains. The upper drain is funnel shaped at 100, and defines an inclined flange 102 bearing the upper membrane 36, 38, being taken in sandwich by a tightening collar 104 secured to the funnel 100 by bolts 106. The collar 104 retaingly secures a debris filter 108 and is provided with a flange 110 to intercept gravel 40. The lower drain is also funnel shaped, at 112, defining an inclined flange 114 taking in sandwich the lower membrane 26 through a tightening collar 116 secured to the funnel by bolts 118. The tightening collar 116 constitutes a central sheath 120, of cylindrical shape and coaxial with the funnel 112.

The lower cylindrical section 122 of funnel 100 is frictionally engaged into the sheath 120. An O-ring 124 surrounds the section 122 and seals the joint between the section 122 and the sheath 120, being biased against the joint by a flange 126 of section 122. The upper funnel 100 will therefore open into the lower funnel 112, whose lower section 128, provided with an inner threading, is designed to be connected to a single return pipe (shown as T in FIG. 2) for discharge of rainwater at two different levels, the water having build up between the two membranes 36, 38 and 26 entering into the lower funnel 112 by spouts 130 made in the collar 116 in register with the funnel 112. These spouts are spaced along an annular section 132 of the collar 116 and project from the inner face of the part 132 to engage with and be sealed by the top of an annular buoyant check valve 134, of square cross-section, which encloses the sheath 120 and which is retained between this annular part 132 and a grate or debris filter, 136, when the valve does not float in the water, i.e. when the water from the intermembrane spacing may flow freely.

An upper grate 137 is secured above the openings 130. If the discharge pipe or another section of the rainwater discharge canalization is obstructed, the buoyant clapper-valve 134, since it will float at the water level, will sealingly close the spouts 130 and water will not be able to backflow into the intermembrane spacing. The spouts 130 are sealed by the water level sensing check valve 134 even if the latter is slightly off-centered with respect to the ring formed by the spouts 130.

The lower grate 136 and the upper grate 137 prevent debris from interrupting the effective operation of valve 134.

The two funnels 100, 112, are secured in place to the roof tile 27 by threaded rods 138, 140 and to locking rings 142.

In the embodiment of FIG. 14, the lower section 122' of the upper funnel 100' is sealingly screwed into the threaded sheath 120' of collar 116'. Thus, the two funnels are now secured to each other and only the threaded rods 140' are required to secure the two-level drain to the tile 27.

Figure 15:
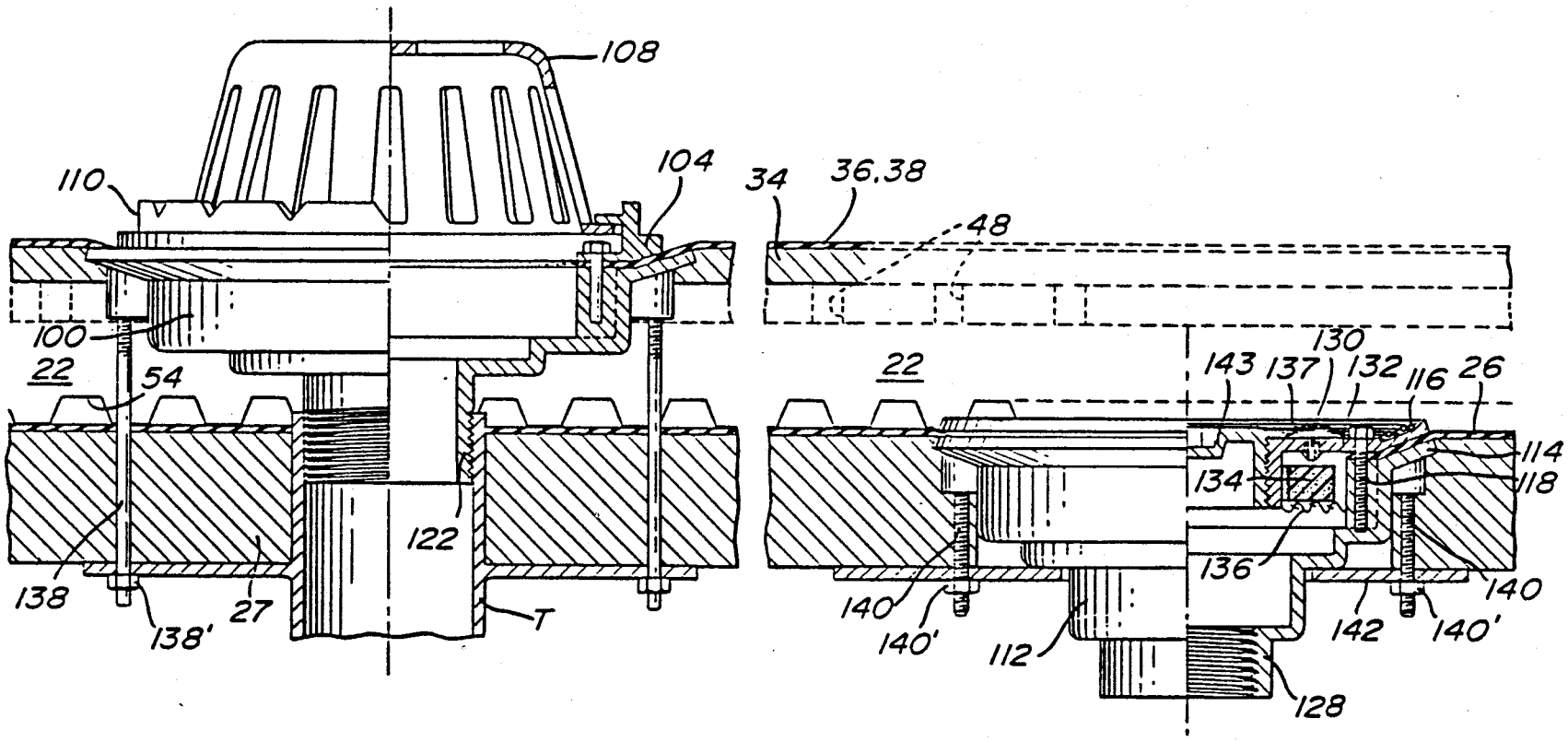

As shown in FIG. 15, the two funnels of the drain of FIG. 14 may be separated and installed in two different positions on the roof, each in communication with its own discharge pipe T. In this case, a plug 143 is screwed into the lower funnel.

In the two embodiments of the hereinabove described two-level drain (FIGS. 13–14), if a malfunction of the check valve occurs, the upper membrane must be disconnected from the upper funnel and the latter must be removed to reach the valve. In the case of FIG. 15, a bore must be made into the cover membrane above the lower funnel. The embodiment of FIGS. 18 and 19 obviates these disadvantages.

The upper drain is funnel shape at 200 and defines an inclined flange 202 against which the upper membrane 36, 38 is taken in sandwich by a tightening collar 204 secured to the funnel 200 by bolts 206. The collar 204 secures a debris filter 208 and is provided with a flange 210 for intercepting gravel 40. The lower drain is also funnel shaped at 212, having an inclined flange 214 which takes in sandwich the lower membrane 26 by an annular tightening collar 216 secured to the funnel 212 by bolts 218. A disc 220 is secured to the bottom of the upper funnel 200 by bolts 222. This disc seals the funnel but is provided with three apertures, each forming the upper opening of a chimney 224 of trapezoidal section which depends from the disc 220 and having a lower end communicating with the lower funnel 212 and secured therewith by bolts 226. The three chimneys 224 establish a passageway between the funnels 200 and 212 and are equally spread apart relative to the vertical axis of the two funnels and are radially spaced from this axis.

Three sector shaped plates 228 are secured to the lower ends of the chimneys 224, extend between these chimneys and abut onto the top of the lower funnel 212 with the sealing joint 230 extending along the periphery of the assembly of chimneys 224 and plates 228. The arrangement of the three chimneys 224, of the upper disc 220 and of the sector plates 228 constitute an intermediate section lodged between the two funnels and defines, between the exterior of the three chimneys, the upper disc and the sector plates, a spacing 232 which communicates with the intermembrane spacing 233 where are located the insulating panels 22. A buoyant ball type check valve 234 is installed into a cage 236. The latter is positioned under the sector plates 228 and its upper end is screwed into a central threaded bore 238 constituted by the plates 228 and the bottom of the chimneys 224.

A valve seat 240 made from a flexible material is installed at the top portion of the cage 236 and secures the check valve 234 in its cage. The seat 240 is removable to enable valve release from its cage.

The two funnels 200 and 212 are secured to the tile 21 by threaded rods 242, 244 and by a locking ring 246 mounted below the tile 21.

The rods 242 which are used to secure the upper funnel 200 are enclosed by spacer tubes 240 which maintain the funnel 200 at the desired level. The bottom of the funnel 212 communicates with a discharge pipe (not shown).

The water having built up within the intermembrane spacing 233 will discharge into funnel 212 through spacing 232, seat 240 and cage 236.

The water on the roof will discharge into funnel 200, chimneys 224 and funnel 212. If water backflows into the discharge pipe and the funnel 212, the ball valve 234 will float and abut against the seat 240 to prevent water from discharging into the intermembrane spacing 233. If the valve, its seat and/or its cage needs to be cleaned, repaired or replaced, the filter 208 will have to be removed, the bolts 222, 226, unscrewed, and the whole assembly 220, 224, 228, 234, 236, 240, removed. Hence, the operation may be effected without having to disconnect the membranes from the funnels.

Figure 21:
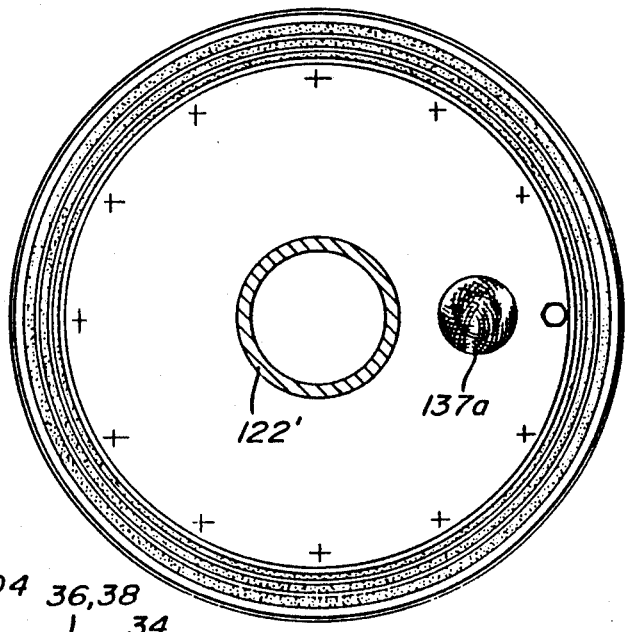
FIG. 21 is a planar section taken immediately above the lower drain section of FIG. 20.
Figure 20:
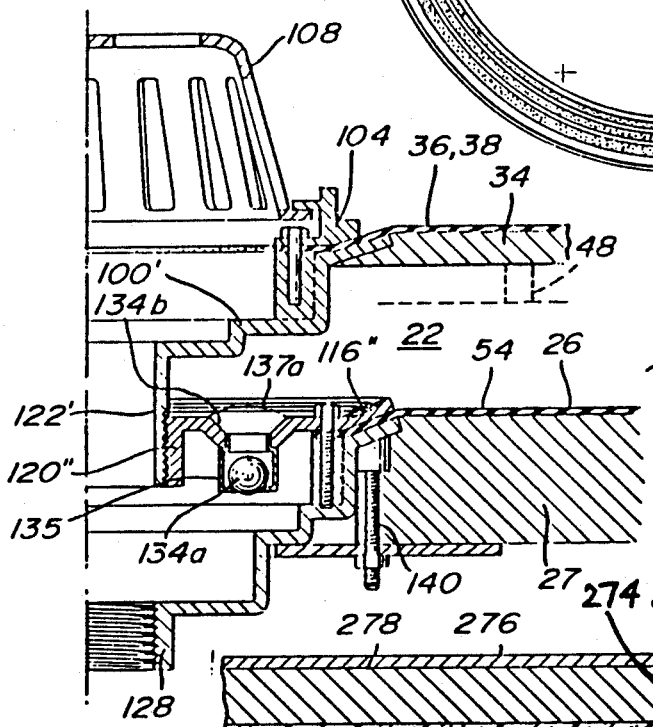
FIG. 20 is a partial section of a two-level drain according to a fourth embodiment of the invention.

The embodiment of two-level drain according to FIGS. 20 and 21 enables also to gain access to the valve and to its cage without having to disconnect the membranes from the funnels. In this embodiment, which is similar to that of FIG. 14, instead of having an annular clapper valve, there is provided a spherical clapper or ball-valve, referenced by 134A, which is mounted into a cage 135 being screwed into the bottom of a dropped frusto-conical part 134B of the collar 116''. The water inside the intermembrane spacing will discharge into the frusto-conical part 134B and into the lower drain through the cage 135, as with the other above-noted systems. To gain access to the valve 134A and its cage 135, the filter 108 is removed and one may extend his hand through the lower section 122' of the upper funnel 100', so as to thus reach the cage 135 which may be unscrewed and pulled out with the valve.

Figure 8:
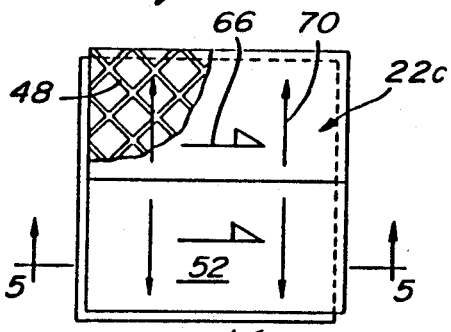
Figure 9:
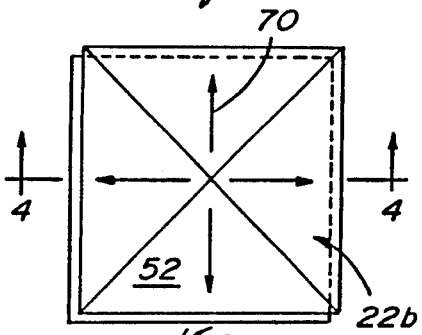

It can now be readily understood how the roofing system works. When the water-tight membrane 36, 38 is ruptured, water seeps through the spacings provided between the support planks and falls onto the self-draining insulating panels, 22. The water flows into the network of upper grooves 48, said network of grooves slopewisely extending along four sectors toward the center (FIG. 6) or exteriorly in three sectors (FIG. 9) or exteriorly onto two sectors (FIG. 8). Water flows by gravity either through the bore 72 or through the joints between the panels accordingly with one or the other ways described in FIGS. 10 and 11. The water then flows onto the fluid-tight membrane 26 through the network of lower grooves 54 formed between the lower abutment legs 56 and is drained exteriorly of the roof by the lower drain.

It is to be noted that the insulating panel must normally be secured to the roof planking 24 through mechanical connectors, not illustrated. On the other hand, it may also be secured on the lower fluid-tight membrane 26, with pressure fit fastening strips, or with a ballast or warm asphalt. In this latter case, it may prove necessary to coat a thermal shield liquid compound 98

Figure 22:
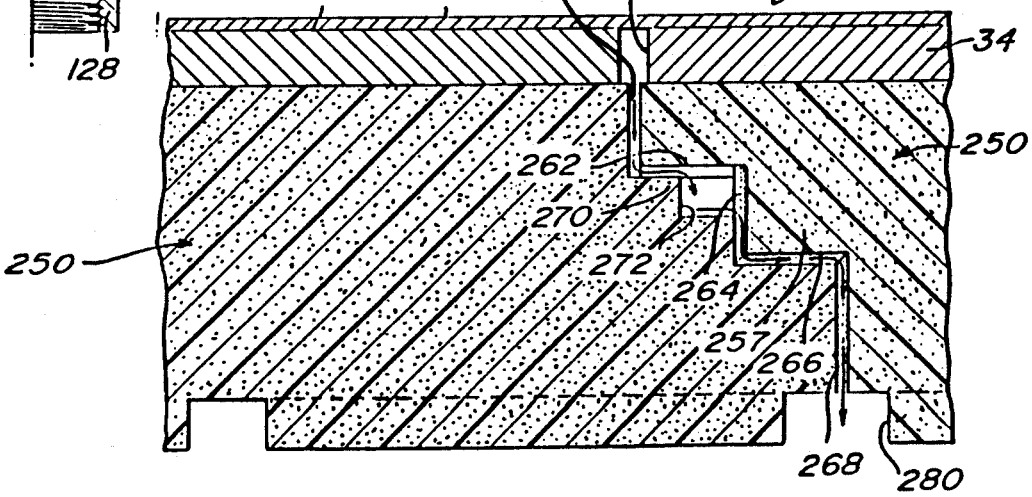
FIG. 22 is a partial vertical sectional view about a joint of two insulating panels, provided with a double lap joint, said sectional view taken along line 22—22 of FIG. 25.

(FIG. 12) onto both faces of the panel 22, or at least onto its lower face, to prevent possible collapse of the insulating panel in the case where its constituting material would not be sufficiently heat-proof. For instance, it is known that an insulating material such as the (rigid) polystyrene foam batts has a melting point of about 65° Celsius, whereas that of warm (liquefied) asphalt will be about 200° C. when spaced spots of asphalt or other liquid adhesive compound are used in conventional manner to secure the upper water-tight membrane to the insulating panels or to the support panels of this membrane, it may happen that this liquid compound, being viscous, may seep into and clog the water channels in the joints of the panels. This is obviated by using modified insulating panels 250, as shown in FIGS. 22 to 25. Each insulating panel 250 forms a double lap joint with a nearby panel; each panel has first and second downwardly-facing notches 252 and 257. Notch 252 is constituted by the vertical face 254 and the horizontal underface 256. Second notch 257 is vertically spaced and is offset from first notch 252, and is defined by a vertical face 258 and a horizontal underface 260. As illustrated in FIG. 25, the two notches thus defined are positioned along the two adjacent sides of the insulating panel 250, whereas the two other adjacent sides of the panel are provided with upwardly-facing third and fourth notches which fit notches 252 and 257 of a nearby panel. The panels may be in staggered arrangement, as shown in FIG. 25. According to a first embodiment, the horizontal underface 256 of the first notch 252 is provided with a plurality of laterally spaced grooves 262 which open onto the vertical face 254 and which extend up to the vertical face 258. The faces 258, 260 are provided with intercommunicating grooves 264 and 266. This latter groove communicates with a groove 268 provided onto the vertical face 270 of the panel. It is to be noted firstly that the plurality of grooves 262 are not distributed on the whole of the first notch 252, but will stop at a given distance from the groove 264. In other words, the latter is laterally offset relative to the proximate groove 262. Moreover, the upwardly facing notch 270 of the adjacent panel is provided with a recess 272 extending the entire length of the panel side. This recess 272 clears the inner part of the grooves 262 as well as the upper part of the vertical groove 264. The vertical faces 258 and 270 will abut against the vertical faces of the corresponding upwardly facing notches of the adjacent panel, whereas the first notch 252 remains spaced from the joined panel, so as to leave an upper a channel 274, as shown in FIG. 22, on all panel sides.

Supposing that the upper membrane 276 (FIG. 22) is glued to the planks 34 with spaced spots or an entire coating of an asphalt layer, the freshly laid and still viscous asphalt, even if it flows into the upper channel 274 at one area, will not be able to clog this channel on all the panel sides. The viscous compound will not be able to flow horizontally to reach the channel 264 and, thus, the latter will never be clogged. The water which will come from the grooves 262 will easily reach the channel 264 through recess 272. Referring to FIG. 22, it is noted that insulating panels 250 do not have a network of grooves on their upper face, such as grooves 48 of FIG. 1. In this embodiment, the first water passage means is located at 278 between upper membrane 276 and planks 34. Passage means 278 are formed around the spaced fastener means (not shown) used to secure membrane 276 to planks 34. Using panels 250, there will always remain a communication between the first water passage means 278, positioned between the water-tight membrane 276 and the support panels 34, and the network of lower grooves 280.

Figure 24:
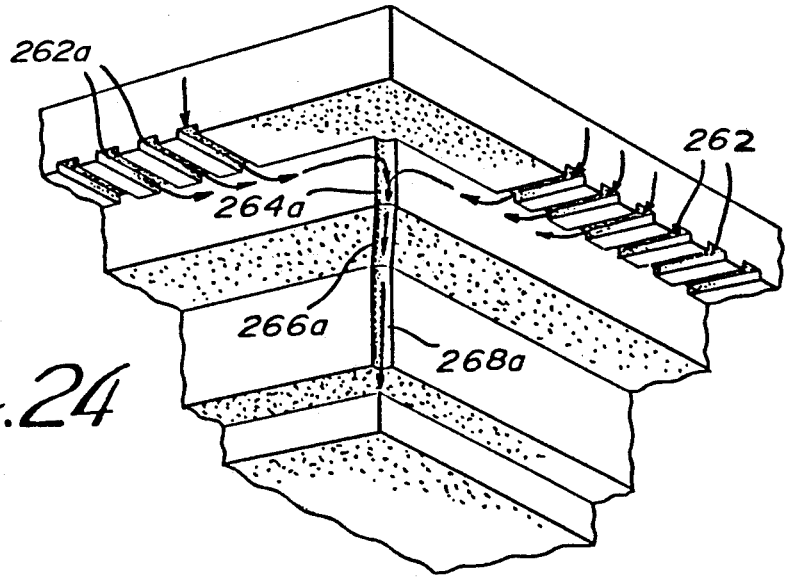
FIG. 24 is a partial perspective view of an insulating panel in which the canalization system has been modified relative to FIGS. 22 and 23.
Figure 23:
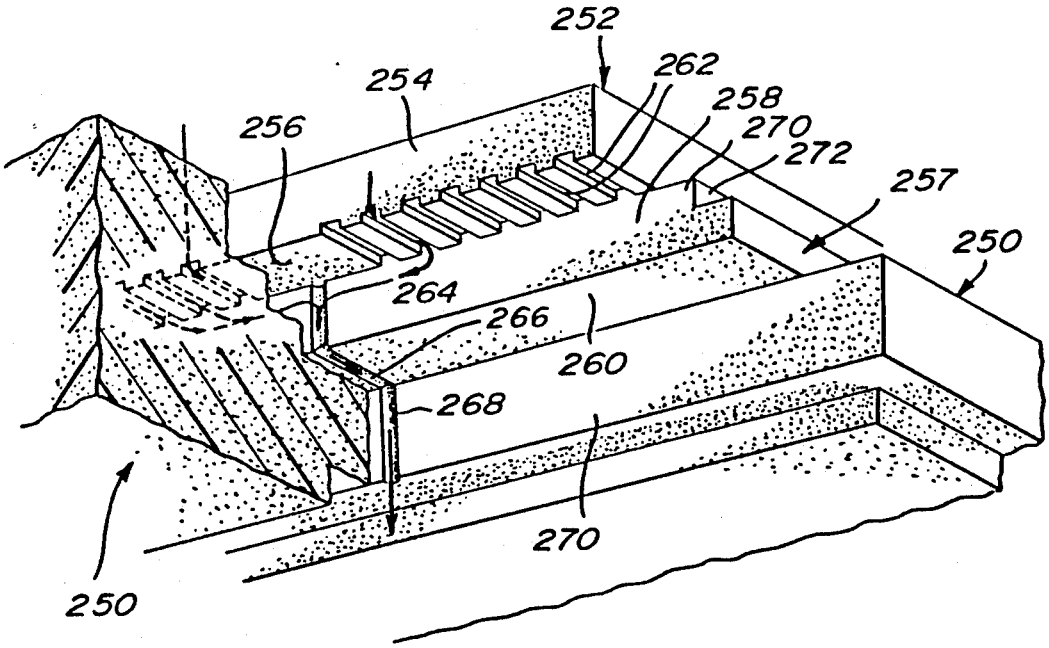
FIG. 23 is a partial, sectional perspective view about the double lap joint of FIG. 22.
Figure 25:
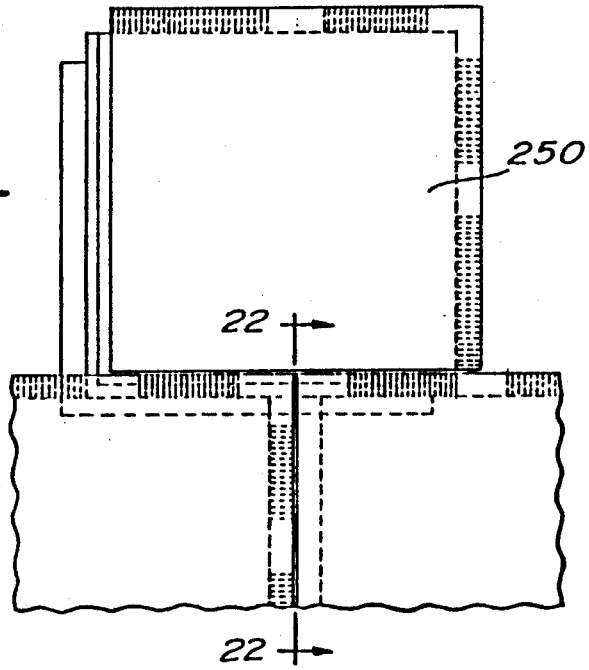
FIG. 25 is a plan view of the insulating panels in staggered arrangement and constructed in accordance with the embodiment of FIGS. 22 and 23.

The same principle is found in FIG. 24 where the equivalent of the grooves 264, 266 and 268 of FIG. 2 is in a corner of the panel, as shown at 264A, 266A and 268A. In this case, the series of grooves 262A, provided in the underface of the first notch is laterally offset from the panel corner. Hence, any viscous compound will be prevented from reaching the groove 266A. Preferably, the insulating panels 250 are in staggered arrangement, as illustrated in FIG. 25.

Figure 26:
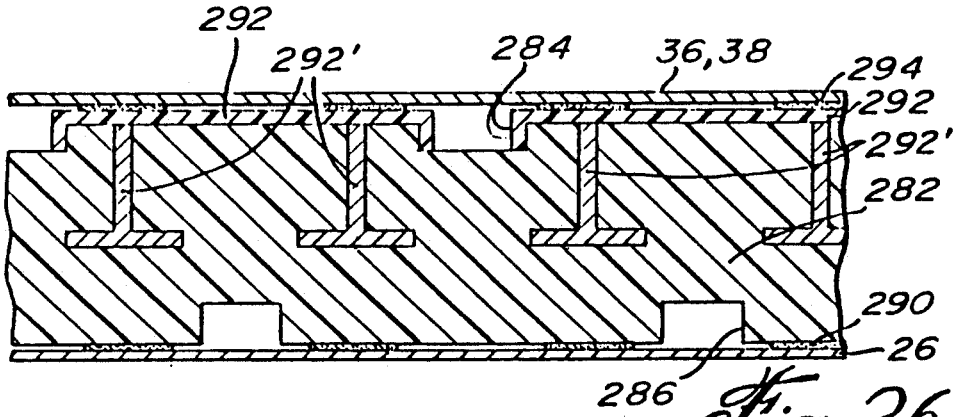
FIGS. 26 and 27 show partial sections of insulating panels modified by the incorporation of securing plates.

FIG. 26 shows another embodiment of insulating panel, referenced 282, being provided with a network of upper and lower grooves 284 and 286. This panel 282 is designed to be glued to a lower fluid-tight membrane 26 through spaced spots 290 of a glue compound. The panel 282 is characterized in that it is provided at its upper surface with rigid plates 292, made from plastic and which are retained to the panel at the time of molding, through inner ribs 292', integral with the plates 292. These plates 292 are used to directly glue the upper membrane 36, 38 through pressure-fit fastener or spaced asphalt strips or spots 294, such that these fasteners or this asphalt strips or spots do not chemically attack the material constituting the insulating panel 282, the latter being normally constituted from expanded polystyrene foam.

Figure 27:
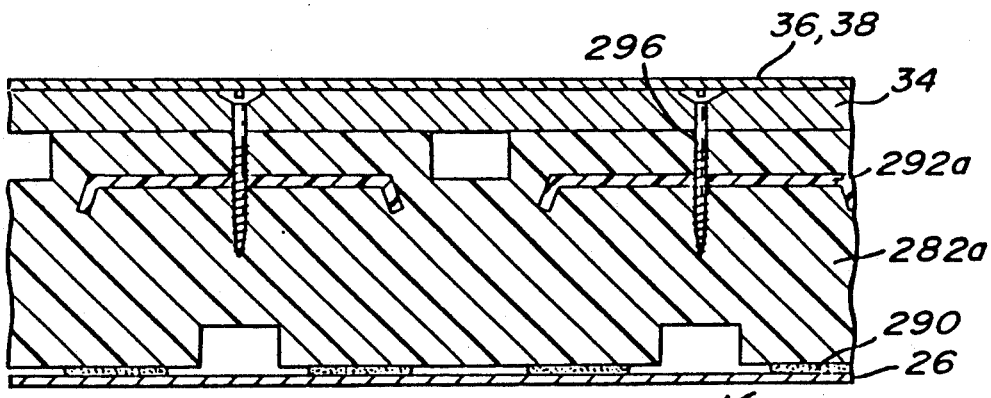

The plates 292 also serve as securing means when the support panels 282 34 are secured to the insulating panels through screws, such as the screws 296 illustrated in FIG. 27. Thus, the plates 292 constitute firm anchoring means for the screws and it is not required that the latter be secured directly to the planking 24. Thus, a thermal bridge is prevented.

FIG. 27 shows an alternate embodiment in which the insulating panel 282A is provided thicknesswisely with rigid strips 292A, made from a metallic or rigid plastic material, which are used as securing means for the screws 296 securing the support plates 34 to the panel. Again, there is no thermal bridge between the screws 296 and the planking 24.

The plates 292A, sunk into the plastic material, cannot produce condensation.

Figure 29:
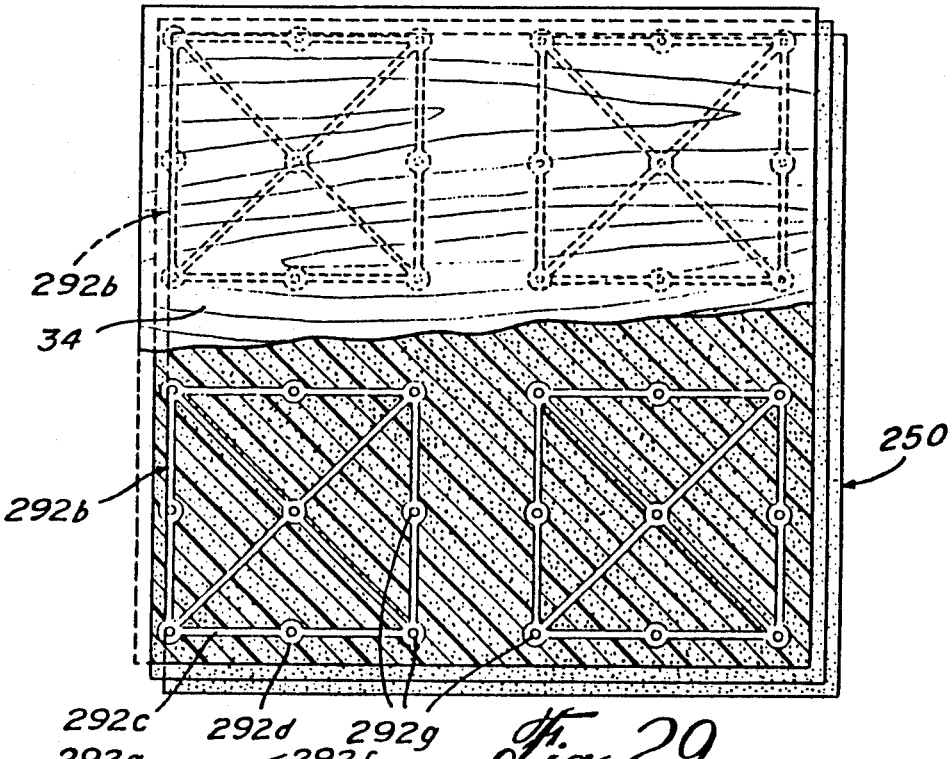
FIG. 29 is a plan view of an insulating panel showing the incorporation of four securing grates accordingly with FIG. 28.
Figure 29A:
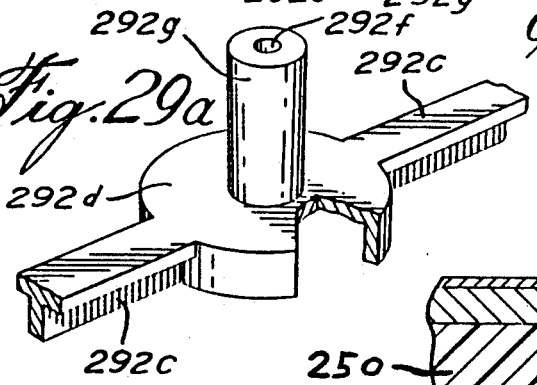

FIGS. 28 and 29 show insulating panels 282*b*, made from plastic foam, such as polystyrene or polyurethane and provided with another securing means for the screws 296. This securing means consists in grates 292*b*, made from a rigid plastic material, such as polystyrene. The panel 282*b*, which is e.g. of square shape, as illustrated in FIG. 29, is provided with four grates 292*b*; each grate consists of four sides and two intersecting diagonals; each of the sides and of the diagonals 292*c* has a T-shape section and constitutes spaced bulges as illustrated in FIG. 28, each bulge being a transverse disc 292*d*, provided with a circular flange 292*e*. A finger 292*g* projects from the disc 292*d* and has a screw bore 292*f*. The grate is held within the plastic foam mold during the molding of the panels 282*b*. The grate is hung by rods in the mold which rods engage bores 292*f*. Each bore 292*f* will be engaged by a screw 296 and the latter will engage the finger 292*g* on almost all of the length of its screwed portion, thus will be used as a very good securing means for the support plank 34. Again, there will be positively no thermal bridge. Preferably, the finger 292*g* will stop about the upper surface level of the insulating panel 282*b*, wherein the bores of screws 292*f* are easily distinguishable.

The support planks 34 may be secured to the grates 292*b*during manufacture. This way, the screws 296 may be positioned in a precise fashion so that they become in register with the screw-receiving bores 292*f*. Therefore, the composite element comprising an insulating panel and a support or covering plank, both of which being of the same dimension and thus of flush peripheral edges, can be produced in the manufacture. The thus obtained unit, e.g. the insulating panel 250 and the support panel 34 shown in FIG. 29, may be installed very rapidly on the roof of a building. In such a case, as shown in FIG. 22, the spacing existing between the support planks 34 and which is referenced 34*a* will be in register with the spacing between the insulating panels 250 and, thus, the possibility that a liquid glue compound or melted asphalt may flow into and clog the third water passage means, will be increased and this is why the double-lap joint panel shown in FIG. 22 is preferred to be used in the panel 250 of FIG. 29 in order to obviate to the clogging of the third water passage means.

It is noted that the composite structures hereinabove described, in accordance with the embodiments of FIGS. 26–28, may be used also for the construction of walls. For an inner wall, the support panels 34 may be replaced by inner covering panels, such as gypsum panels. For an external wall, a grate may be provided to replace the planks 34, this grate being used as a spacer for producing an air spacing and support for the external covering of the house.

Preferably, the two-level draining system shall be provided with a sound alarm providing a sound signal that water has collected within the intermembrane spacing since detection of such water build up is not visually possible. The owner will then be able to know when his roofing needs repairs. Such a sound alarm preferably comprises two electrodes 148 (FIG. 13), consisting of live wires arranged in concentric rings onto the tightening collar 116 and secured to the latter. One of these wires must be electrically insulated from collar 116 but the two wires must be electrically exposed to water. The conductivity of water will be sufficient for the passage of electric current between the electrodes 148. Known means will detect the current.

FIG. 30 shows another sound alarm system revealing the presence of water in the intermembrane spacing. In this figure, the planking 300 is shown as being a concrete tile provided with a bore 302 in which is supported the lower drainpipe 306 through a metallic ring 304, this drainpipe being at a position laterally spaced from the upper drain member (not shown). The drain member 306 is provided with a tightening collar 308, which constitutes a grate for the passage of water and which is screwed to the drain member 306 by bolts 310 to retain in sandwich between the drainpipe and the collar the lower fluid-tight membrane 310 to the periphery of its opening communicating with the drain. The insulating panels 314 are supported onto the fluid-tight membrane 310. Each panel 314 is provided with a network of grooves 316 on its lower face, whereas its upper face is grooveless and supports the support plants 34 to the top face of which is secured the water-tight membrane 36, 38 by spaced fasteners, such as asphalt spots, as previously described, thereby leaving sufficient space between membrane 36, 38, and planks 34 to form the first water passage means. The lower drain is secured in place by bolts 318 and the locking ring 320 which abuts under the tile 300. Water which could seep into the intermembrane spacing will automatically discharge into the drain 306. The latter is not provided with a check valve but is in permanent communication with a pipe 322 provided with an elbow so as to have a horizontal part comprising a manual valve 324 having a threaded end socket 326; valve 324 is normally closed and is operated by a lever arm 328. Upstream of the valve 324, there is positioned a casing 330 supporting a dependent bowl 332 made from a transparent material in which there is a float 334. The bowl 332 projects below the ceiling 336 of the room immediately below the roof of the building. If water seeps into the intermembrane spacing because of the rupture of the upper membrane 36, 38, water will flow along the lower fluid-tight membrane 310 into the lower drain member 306, so as to discharge into the bowl 332. The float 334 will become buoyant, constituting a visual clue that water is present within the intermembrane spacing. This water may be removed by connecting a hose 338 to the end socket 326 and by opening valve 324 through operation of lever 328. Normally, the ceiling 336 is a suspended ceiling consisting of tiles which may be very easily removed. If desired, an electrical system may detect the presence of water in the bowl 332 and sound an alarm. Preferably, the bottom of bowl 332 is provided with a bowl draining hole closed by a valve 333 which is opened to empty the bowl without having to remove the tiles of the ceiling 336.

We claim:

1. In a building roof draining system for a horizontal or slightly sloped flat roof including a heat-insulating layer formed of a plurality of heat-insulating panels joined side by side and having an upper and a lower face, an upper watertight membrane covering said layer, a lower fluid-tight membrane underlying said layer and an upper drain member sealed to and opening above the upper membrane for draining surface water from the roof, the improvement comprising a first water passage means located between said upper membrane and said layer, a second water passage means located between said layer and said lower membrane, and a third water passage means through said layer; and a lower drain member sealed to and opening above the lower membrane and under said layer for draining from the roof water collected between the two membranes, said first, second and third water passage means and said lower drain member being in mutual communication.

2. In a roof draining system as defined in claim 1, wherein the two drain members are vertically aligned, the upper drain member discharging into the lower drain member and further including an anti-back flow valve means located in said lower drain member to prevent water flowing from said upper drain member to enter the space between the two membranes through said lower drain member.

3. In a roof draining system as defined in claim 1, wherein said first passage means includes a network of intersecting grooves made in the upper face of said panels.

4. In a roof draining system as defined in claim 1, wherein said second water passage means includes a network of intersecting grooves made in the lower face of said panels.

5. In a roof draining system as defined in claim 1, wherein said first passage means includes a spacing between the upper water-tight membrane and the upper face of said panels.

6. In a roof draining system as defined in claim 1, wherein said third passage means includes bores made through the insulating panels.

7. In a roof draining system as defined in claim 1, wherein said third water passage means includes channels formed at the edges of the panels.

8. In a roof draining system as defined in claim 7, wherein said second water passage means includes a network of intersecting grooves made in the lower face of said panels.

9. In a roof draining system as defined in claim 1 wherein said panels are molded and made of plastic foam.

10. In a roof draining system as defined in claim 8, wherein said panels are molded and made of plastic foam.

11. In a roof draining system as defined in claim 1, wherein the thickness of the insulating panels decreases towards said upper drain member.

12. In a roof draining system as defined in claim 9, wherein the insulating panels have stepped side edges formimg lap joints when said panels are joined side by side.

13. In a roof draing system as defined in claim 1, in which each panel is quadrangular and has first and second downwardly-directed notches on two adjacent sides of the panel, said first and second notches being vertically spaced and horizontally offset, and third and fourth upwardly-directed notches on the other two sides of the panel similarly vertically spaced and laterally offset to form a double-lap joint with an adjacent panel, each notch comprising a vertical face and a horizontal face, the third water passage means including a plurality of laterally-spaced grooves in the horizontal face of the first notch and a vertical groove in the vertical face of the second notch, said vertical groove laterally offset relative to the nearest groove of said plurality of grooves, the junction of the first and third notches forming a horizontal recess which establishes a liquid communication between the grooves of said plurality of grooves and said vertical groove when the double-lap joint is completed.

14. In a roof draining system as defined in claim 1, further including a sheet of thermal protection covering and adhering to the lower face of the insulating panels.

15. In a roof draining system as defined in claim 1, further comprising indicating means to indicate the presence of water between the two membranes.

16. In a roof draining system as defined in claim 15, in which said indicating means comprises electrodes exposed within the lower drain member.

17. In a roof draining system as defined in claim 15, in which said indicating means comprises a transparent bowl located below said roof in a position visible within the building and located below and communicating with said lower drain member, and a buoyant ball in said transparent bowl.

18. In a roof draining system as defined in claim 17, in which said transparent bowl has a normally-closed bowl draining hole.

19. In a roof draining system as defined in claim 17, further including piping communicating with said lower drain member for discharging, outwardly of the roof, water which may have collected between the two membranes and valve means closing said piping, said transparent bowl depending from said piping upstream from said valve means.

* * * * *